US007413074B2

(12) United States Patent
Barr

(10) Patent No.: US 7,413,074 B2
(45) Date of Patent: Aug. 19, 2008

(54) TWO COMPARTMENT BOTTLE WITH MIXING DEVICE

(76) Inventor: Otis Barr, 1908 Orchard Rd., Hood River, OR (US) 97031

( * ) Notice: Subject to any disclaimer, the term of this patent is extended or adjusted under 35 U.S.C. 154(b) by 603 days.

(21) Appl. No.: 11/000,592

(22) Filed: Dec. 1, 2004

(65) Prior Publication Data

US 2005/0115983 A1 Jun. 2, 2005

Related U.S. Application Data

(60) Provisional application No. 60/526,178, filed on Dec. 2, 2003.

(51) Int. Cl.
*B65D 25/08* (2006.01)

(52) U.S. Cl. ..... 206/219; 206/221; 215/DIG. 8; 220/502

(58) Field of Classification Search ..... 206/219, 206/220, 221; 215/265, 396, DIG. 8; 220/916, 220/715; 222/135, 142.1, 94, 96; 137/572
See application file for complete search history.

(56) References Cited

U.S. PATENT DOCUMENTS 4,779,722 A * 10/1988 Hall ..... 206/221
5,008,083 A * 4/1991 Dickie et al. ..... 422/101
5,299,720 A * 4/1994 Koch, III ..... 224/406
5,875,888 A * 3/1999 Albisetti ..... 206/221
6,032,841 A * 3/2000 Johnson ..... 224/463
6,073,803 A 6/2000 Sturm et al. ..... 222/80
6,372,270 B1 4/2002 Denny ..... 426/77
6,540,070 B1 4/2003 Conwell ..... 206/219
2004/0159625 A1 * 8/2004 Kwon ..... 215/329

* cited by examiner

*Primary Examiner*—Mickey Yu
*Assistant Examiner*—Steven A. Reynolds
(74) *Attorney, Agent, or Firm*—Buskop Law Group, PC; Wendy Buskop

(57) ABSTRACT

A bottle is described herein. The bottle generally includes a first end, a second end, at least one removable support, at least one support groove clip operably connected to the at least one removable support, a first opening disposed at the first end, a second opening disposed at the second end, at least two caps adapted for securing the first opening and the second opening, a divider disposed proximate a center of the bottle and a handle disposed proximate the center.

10 Claims, 3 Drawing Sheets

TWO COMPARTMENT BOTTLE WITH MIXING DEVICE

The present application claims priority to co-pending U.S. Provisional Patent Application Ser. No. 60/526,178 filed on Dec. 02, 2003.

FIELD

Embodiments relate to a device and method for mixing beverages, and more specifically to various embodiments of containers, plunging devices, and dividers, for a bottle capable of storing two different beverages separately until it is desired that they be mixed together.

BACKGROUND

A water bottle with a plunger device is shown in U.S. Pat. No. 6,540,070. By moving the plunger downwards a seal is broken allowing a concentrated flavoring to mix with water within the water bottle.

In U.S. Pat. No. 6,372,270 a method and apparatus is provided for making or brewing beverages, notably tea. The device involves an attachment to the cap of a bottle that has a plunger portion. The drink mix or tea bag is within a seal to prevent mixing until it is desired.

U.S. Pat. No. 6,073,803 describes a container with two receiving spaces that are initially separated by a diaphragm or a closure plug. A cutting edge is used to slit open a diaphragm, and a plunger is used to open a closure plug. These opening devices are activated by a screwing motion.

In the first two patents a seal is used to prevent mixing of the beverages before the desired mixing. The downside to this is that once the seal is broken, the bottle must be refitted with a new seal before it can be used again. This can be time consuming and awkward. The third patent was designed to be used for mixing cosmetics, a liquid media that sometimes must be mixed just before use.

Therefore, it can be appreciated that there exists a continuing need for a new and improved bottle that can store two different kinds of beverages or liquids that can then be intermingled using a plunging device in the region that separates the two compartments of the bottle. In the present embodiments, no seal is used. The plunger operates in the divider section in the middle of the bottle. In this regard, the present embodiments substantially fulfill this need.

SUMMARY

The object of the present embodiments is to provide such a container with two receiving spaces for beverages that are initially stored separately and are to be mixed together before use, whereby said container has as simple a structure as possible, which consists of as few individual parts as possible and which, after the beverages are mixed, makes it possible to readily access the mixture of the beverages.

BRIEF DESCRIPTION OF THE DRAWINGS

Aspects of the present bottle will be described in greater detail with reference to the appended figures.

DETAILED DESCRIPTION OF THE PREFERRED EMBODIMENTS

Before explaining the present embodiments in detail, it is to be understood that the embodiments are not limited to the particular embodiments and that it can be practiced or carried out in various ways.

A detailed description will now be provided. Each of the appended claims defines a separate embodiment, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the pertinent art to make and use the inventions, when the information in this patent is combined with available information and technology. Various terms as used herein are defined below. To the extent a term used in a claim is not defined below, it should be given the broadest definition persons in the pertinent art have given that term as reflected in printed publications and issued patents.

Figure 1:
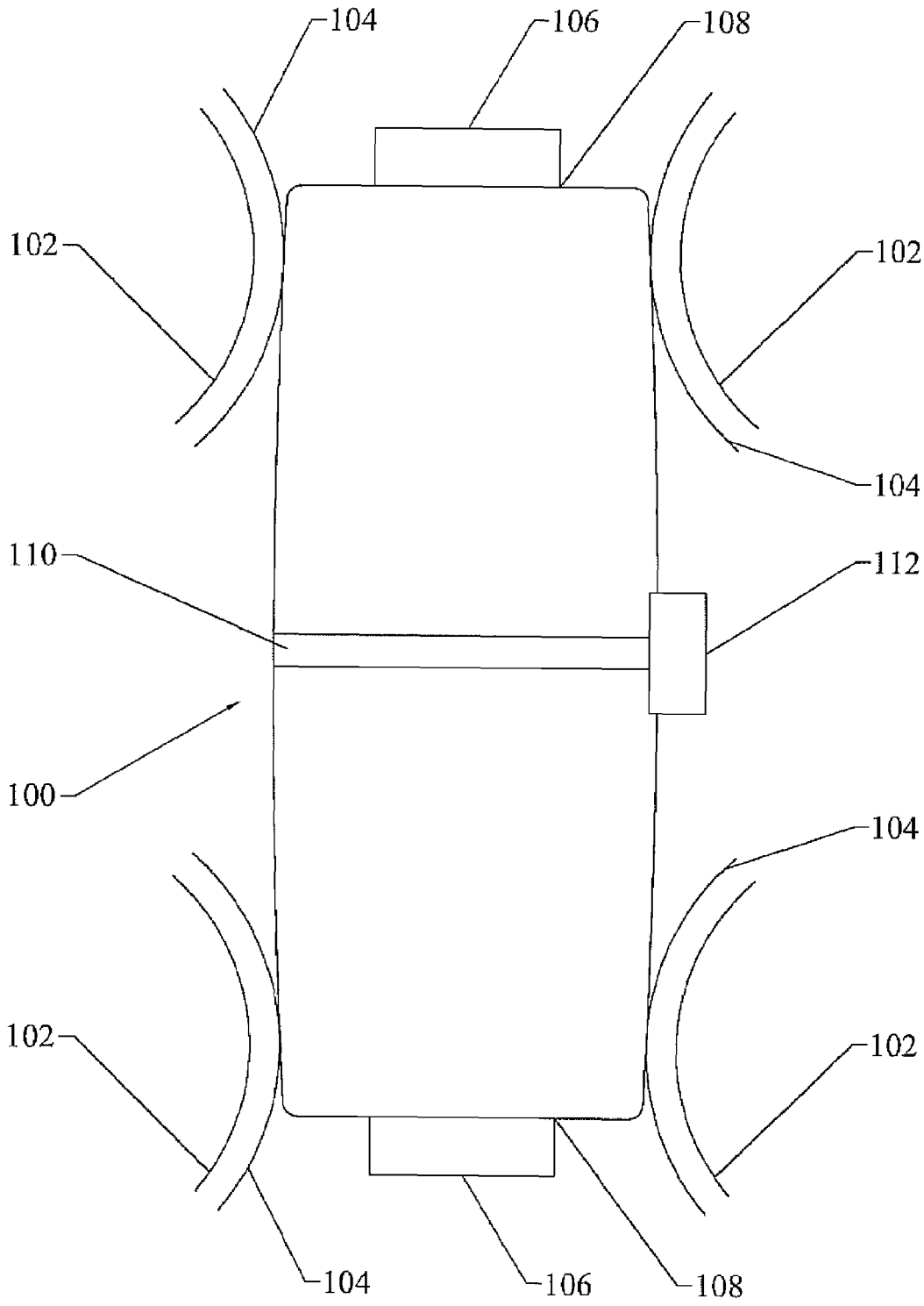
FIG. 1 is a full length picture of the bottle, showing the removable supports, support groove clips, divider, and handle.

FIG. 1 illustrates a bottle 100 having removable supports 102. The removable supports 102 are generally removable for each side. The removable supports are generally from about 1 inch to about 10 inches long. They can be made of plastic, metal, wood, or combinations thereof.

Further, support groove clips 104 support the removable supports 102. The support grooves are generally from about 0.25 inches to about 5.5 inches long. The support grooves can be made of plastic; in a preferred embodiment a clear variety of plastic is used.

The bottle has two openings 108, with each opening 108 being disposed at opposing ends of the bottle 100. The bottle 100 further includes at least two caps 106, with each cap being adapted to secure each opening 108.

Further, the bottle can include a divider 110 and a handle 112. In one embodiment, the divider 110 is positioned in approximately the center of the bottle 110.

The bottle 100 is generally adapted to hold from about 4 liters to about 25 liters of a liquid.

Figure 2:
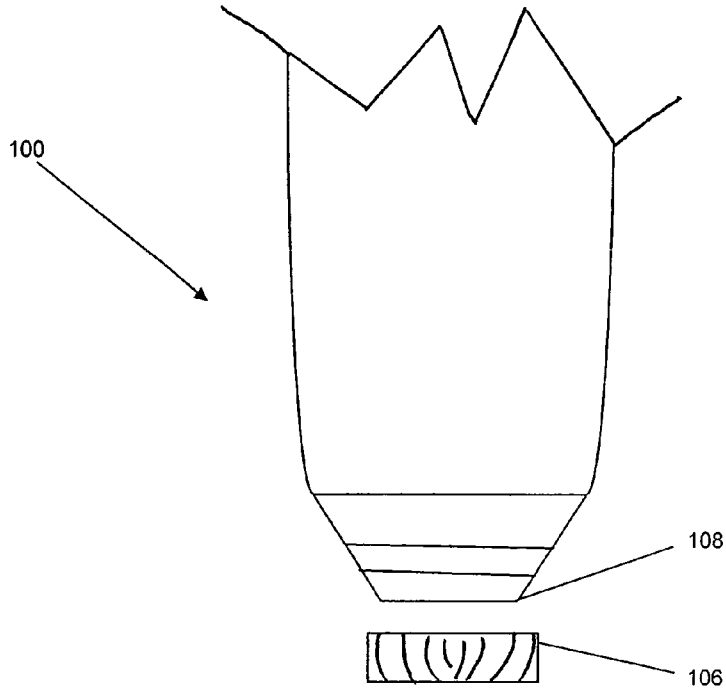
FIG. 2 illustrates how one of the caps fits onto the end of one of the openings.

FIG. 2 illustrates one end of the bottle 100 and shows how one of the caps 106 fits onto the end of one of the openings 108. The cap can be of a threaded, clips-on, or press-on variety.

Figure 3:
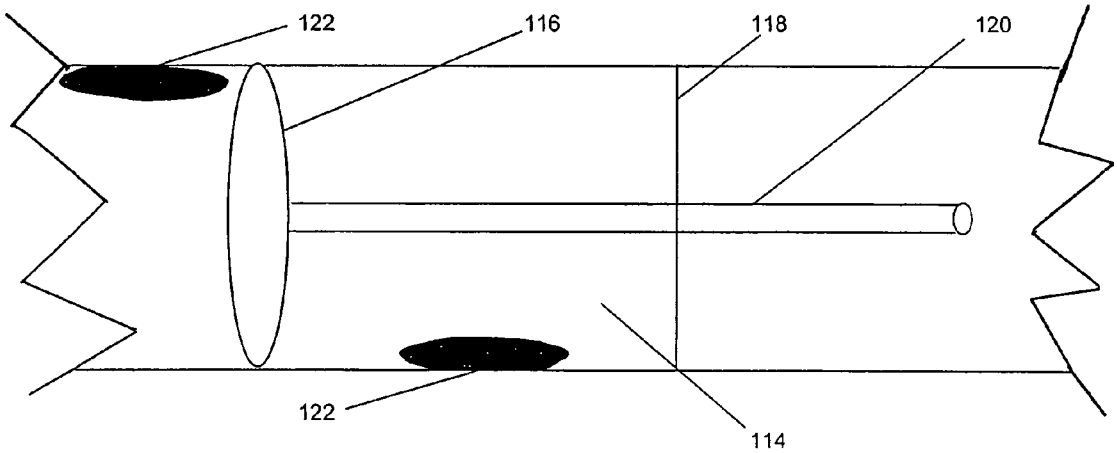
FIG. 3 depicts the divider with the inlet chamber, rubber plunger, and plunger stopper for mixing the two liquids.

FIG. 3 shows the divider 110 and the method for mixing liquids between the two ends of the bottle 100. The height of the divider 110 is generally between 0.5 inches and 3 inches in length.

The divider has an inlet chamber 114 for contents, a rubber plunger 116, and a plunger stopper 118 made of rubber grommet. The inlet chamber is generally 1.5 inches in diameter. The rubber plunger 116 is connected to an opener rod 120 made of aluminum stainless steel. The opener rod 120 extends outside of the bottle 100 and is connected to the handle 124.

Further there are two holes 122 in the inlet chamber, one on each side of the divider 110. The holes are located on the other side of the plunger stopper 118, where the rubber plunger 116 is also located. The holes are generally between 0.25 inches and 2 inches in diameter. Liquid flows out from the holes and into the bottle when the rubber plunger 116 is opened using the opener rod 120, using a vacuum seal technique.

Figure 4:
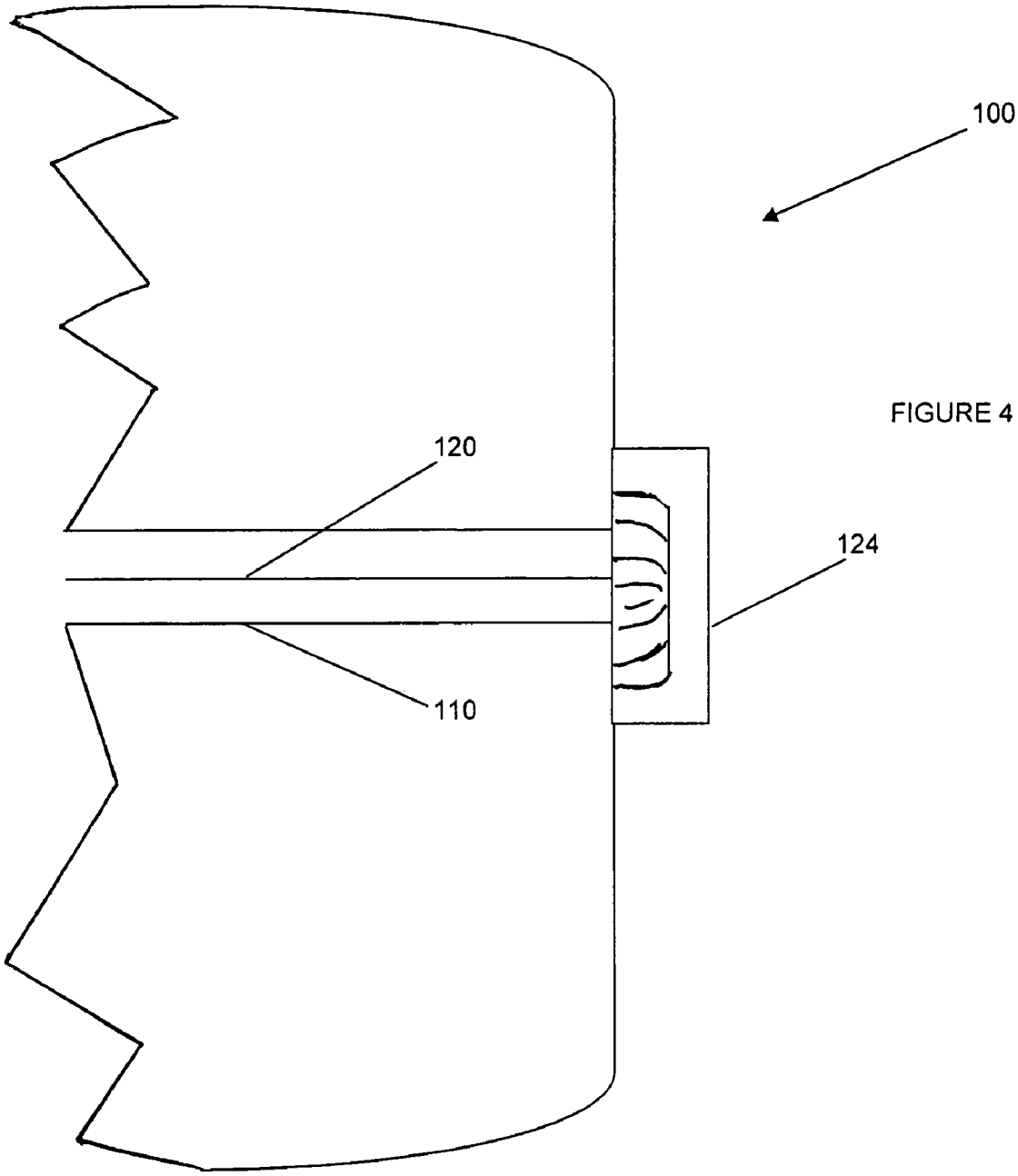
FIG. 4 depicts the handle of the bottle.

FIG. 4 shows the handle 124 that is connected to the bottle 100. The handle is located on the outside of the bottle 100 and is connected to the opener rod 120 that is inside the divider 110. The handle can be pulled away from the bottle 100 and pushed towards the bottle 100 in order to move the plunger inside the bottle 100 which in turns moves liquids from one side of the divider 110 to the other.

While the foregoing is directed to the preferred embodiments of the present invention, other and further embodiments of the invention can be devised without departing from the basic scope thereof, and the scope thereof is determined by the claims that follow.

What is claimed is:

1. A bottle comprising:

a. a first end;

b. a second end;

c. at least one removable support;

d. at least one support groove clip operably connected to the at least one removable support;

e. a first opening disposed at the first end;

f. a second opening disposed at the second end;

g. at least two caps adapted for securing the first opening and the second opening;

h. a divider disposed proximate a center of the bottle;

i. a handle disposed proximate the center; and j. wherein the divider comprises:

i. a first side in fluid communication with the first end;

ii. a second side in fluid communication with the second end;

iii. an inlet chamber disposed between the first side and the second side;

iv. a plunger disposed within the inlet chamber, secured to an opener rod, wherein the opener rod is parallel to the first side and the second side and is secured to the handle;

v. a first hole disposed on the first side of the inlet chamber and a second hole disposed on the second side of the inlet chamber, and wherein the first hole and the second hole are configured such that the plunger rests between the first hole and the second hole when the plunger is in a first position; and vi. wherein when the plunger is moved to a second position the first hole is in fluid communication with the second hole; and wherein when the plunger is in the second position the plunger engages a plunger stopper disposed within the inlet chamber; and vii. wherein fluid from the first side and fluid from the second side are sucked into the inlet chamber using a vacuum seal technique.

2. The bottle of claim 1, wherein the at least one removable support comprises a length ranging from about 1 inch to about 10 inches.

3. The bottle of claim 1, wherein the at least one removable support is formed from a material selected from the group consisting of plastic, metal, wood or combinations thereof.

4. The bottle of claim 1, wherein the bottle is adapted to hold from about 4 liters to about 25 liters of fluid.

5. The bottle of claim 1, wherein the at least two caps are threaded, clip-on, or press-on.

6. The bottle of claim 1, wherein the divider comprises a height of from about 0.5 inches and 0.3 inches.

7. The bottle of claim 1, wherein the plunger is formed of rubber.

8. The bottle of claim 1, wherein the plunger stopper comprises a rubber grommet.

9. The bottle of claim 1, wherein the opener rod is formed of aluminum stainless steel.

10. The bottle of claim 1, wherein the inlet chamber comprises a diameter of from about 1 inch to about 2 inches.

* * * * *